US007908671B2

(12) United States Patent
Gaugler et al.

(10) Patent No.: US 7,908,671 B2
(45) Date of Patent: Mar. 22, 2011

(54) EXPANDABLE GARMENT FOR CHILDREN

(75) Inventors: Teresa K. Gaugler, Dunn Loring, VA (US); Hélène J. Courard, Arlington, VA (US)

(73) Assignee: Growables LLC, Dunn Loring, VA (US)

( * ) Notice: Subject to any disclaimer, the term of this patent is extended or adjusted under 35 U.S.C. 154(b) by 1228 days.

(21) Appl. No.: 11/517,243

(22) Filed: Sep. 8, 2006

(65) Prior Publication Data

US 2007/0056076 A1 Mar. 15, 2007

Related U.S. Application Data

(60) Provisional application No. 60/716,007, filed on Sep. 9, 2005.

(51) Int. Cl.
*A41B 13/06* (2006.01)

(52) U.S. Cl. ..... 2/69.5; 2/75; 2/80; 2/83

(58) Field of Classification Search ..... 2/69.5, 2/75, 80, 83, 111, 67, 73, 78.3
See application file for complete search history.

(56) References Cited

U.S. PATENT DOCUMENTS

| | | | | |
|---|---|---|---|---|
| 1,308,457 | A * | 7/1919 | Tully | 2/228 |
| 1,929,015 | A * | 10/1933 | Collins | 2/111 |
| 4,894,867 | A * | 1/1990 | Ceravolo et al. | 2/238 |
| 6,605,071 | B1 * | 8/2003 | Gray et al. | 604/385.28 |
| 2009/0187156 | A1 * | 7/2009 | Anzalone | 604/385.03 |

* cited by examiner

*Primary Examiner* — Gary L Welch
*Assistant Examiner* — Alissa J Tompkins
(74) *Attorney, Agent, or Firm* — Hershkovitz & Associates, LLC; Abraham Hershkovitz

(57) ABSTRACT

A one-piece garment with elastic bands threaded through the binding at the leg openings that allows for custom fitting of the garment. The contraction of the elastic bands through the cord-lock fastener creates a drawstring effect and provides a gathering force upon the garment, which is held securely in place with the cord-lock fastener so that the lower portion of the one-piece bodysuit thereby shortens in length and tightens around the legs to form a snug fit. Once the desired length is attained, the elastic bands and the cord-lock fastener are stored in the back flap of the crotch in a separate compartment, or pocket, held securely closed during wear with a strip of hook and loop fastener. The one-piece bodysuit can be expanded as needed by releasing the cord-lock fastener and pulling the elastic bands back through the cord-lock fastener to loosen the gathered fabric, thereby extending the crotch length of the garment and the diameter of the leg openings.

14 Claims, 3 Drawing Sheets

EXPANDABLE GARMENT FOR CHILDREN

CROSS-REFERENCE TO RELATED APPLICATIONS

The present application is a continuation of U.S. Provisional Application Ser. No. 60/716,007, filed Sep. 9, 2005, the entire disclosure of which is hereby incorporated herein by specific reference thereto.

BACKGROUND OF THE INVENTION

1. Field of the Invention

Generally, the invention relates to clothing and in particular to children's clothing. Specifically, the present invention relates to one-piece bodysuits for children.

2. Discussion of Background Information

Children grow quickly, especially in the first few years of life. As a result, infants, toddlers, and other children often quickly outgrow their clothing, leading parents to purchase new clothing frequently and incur significant costs. Traditional children's clothing does not adequately address this issue because garments are designed to fit for only short time spans. For example, traditional infant clothes are sized in 90-day increments (i.e., 0-3 months, 3-6 months, 6-9 months, and 9-12 months) so they are not designed to fit a growing child for more than a few months. Additionally, garments for toddlers aged one to two years usually are designed to fit for 6-month increments (i.e., 12-18 months and 18-24 months), meaning that during the first two years of a child's life, a parent may have purchased six different wardrobes of clothing to outfit the child.

Because the lifecycle of traditional infant's, toddler's, and other children's clothing is so short, many parents buy clothes a size larger than their child currently wears, hoping for longer wear from those clothes. Of course, that often results in the clothing being baggy or ill fitting on the child when first purchased. Thus, parents are thrust into a conundrum: purchase the proper size to currently fit their child but in the future spend more time and money buying more clothes more often, or save time and money by purchasing a larger size that will last longer but suffer dressing their child in ill-fitting clothes.

Therefore, a need exists for children's clothing that provides a comfortable snug fit with a longer lifecycle than traditional children's garments.

SUMMARY OF THE INVENTION

The present invention extends the lifecycle of a child's one-piece bodysuit such that the garment extends in crotch length and leg opening diameter, "growing" with a child for longer wear. The invention allows the bodysuit to expand and properly fit an infant, a toddler or other child throughout an entire year, reducing the need for parents to purchase new clothing by about two-thirds during their child's first two years.

More particularly, it pertains to a one-piece garment that enables a more effective fit on a child's body because its crotch length can be periodically adjusted to fit snugly as the child grows, extending the lifecycle of the garment. The length of the garment can be adjusted to match the torso length of a child through the aid of elastic bands threaded through the leg binding and adjusted by a cord-lock fastener. A separate compartment, or pocket, in the back flap of the crotch allows for storage of the elastic bands and the cord-lock fastener when not in use to adjust the size. This pocket is held securely closed with a hook and loop fastener and remains closed during wear.

Other objects include: providing a garment, with front, back and crotch portions, the front and back portions having a length extending down to the crotch portion, and leg openings having a diameter formed at the lower edges of the front, back and crotch portions. The lower edges can have a leg seam binding with an internal passage extending around the circumference of each leg opening. The garment also is adjustable to change the length of the garment and the diameter of the leg openings simultaneously.

An adjustment device can include at least one cord, extending within and at least partially through said binding around each leg opening. The cord may be an elastic band.

The garment can include a cord for each leg opening, each with an end secured within the binding of each leg opening. Each leg seam binding has an opening through which the cord extends to provide an exposed accessible cord portion. The cord is fixed at one end within the binding and can move freely within the binding along its length to increase or decrease the length of the accessible portion and gather or release the garment between the fixed end and the opening. A fastener is releasably fixed along the length of each accessible portion to determine the length extending out of said opening and create a drawstring effect.

A single common fastener joins the accessible portions of each cord to determine the exposed length and simultaneously holds each accessible portion at a desired adjustment to determine the amount of gathering and the length of the garment and the diameter of the leg openings. In a particular embodiment, the common fastener is a cord-lock fastener and a single continuous cord passes through each leg seam binding. Each accessible portion is continuous with the other and attached to the common fastener.

The crotch portion is formed from front and back crotch flaps, releasably joined by a securing device. A storage pocket is located on the back crotch flap, and each leg seam binding opening opens into that pocket to allow the accessible portions of each cord to extend into the pocket, such that the accessible portions and the common fastener can be located within the pocket. The pocket has an access opening which can be releasably closed by cooperating strips of hook and loop fasteners.

Aspects of the invention provide a one-piece bodysuit for an infant, toddler, or other child having a neck opening, a torso covering, including a front and back, the front and back torso coverings terminating at their lower edges in front and back crotch flaps, a securing device for releasably joining the front and back crotch flaps to define leg openings, a pocket formed on at least one of the front and back crotch flaps, the pocket including an access opening, such that items may be stored in and removed from the pocket.

The front and back crotch flaps overlap when joined, and are secured by at least one set of cooperating stud and socket snap fasteners. The front crotch flap has a downwardly curved lower edge, and a leg seam binding extends around the lower edge of each leg opening and each of the front and back crotch flaps.

In one aspect of the invention, three distinct sets of snap fasteners secure the crotch flaps in their overlapping relation. The front crotch flap may use either stud or socket snap fasteners spaced along the lower crotch binding with a first stud or socket located at the center of the binding and second and third studs or sockets on each side of center. In cooperation with the snap fasteners on the front crotch flap the back crotch flap includes three snap fasteners comprising the other of the stud or socket for cooperating with the snap fasteners of the front crotch flap. A center one of the back crotch flap snap fasteners is located inwardly and upwardly from the lower edge binding about 1.5 inches, for proper placement to cooperate with the center snap fastener on the downwardly curved front crotch flap. The pocket is located on the inside of the back crotch flap, and has an upper edge that is sewn closed. The center back crotch flap snap fastener is located adjacent the upper edge of the pocket.

The front and back crotch flaps have a downwardly extending length, and the leg openings, formed when the crotch flaps are joined, have a diameter such that the leg opening diameter and crotch length are adjusted simultaneously, whereby the bodysuit can be expanded or contracted to the size of the wearer.

In the one-piece bodysuit, the lower edges of the front, back and crotch flaps have a leg seam binding with an opening, opening into the pocket. An adjustment device, for example a band of material or an elastic band, can include a cord passing through the binding and extending through the opening to provide an accessible portion within the pocket, the cords being fixed at one end within the binding and free to move under tension along their length within the binding to vary the extension of the accessible portion. A common fastener for the accessible portions of each cord within the pocket is used to determine the cord length within the binding and thus adjust the length and diameter simultaneously. A closure device closes or enables access through the access opening into the pocket.

The instant invention provides an infant's, toddler's, or other child's one-piece bodysuit including at least one of a neck opening and sleeves, and having a torso covering, including a front and back, the front and back torso coverings terminating at their lower edges in front and back crotch flaps, and a leg seam binding around the lower edges of the front, back and crotch flaps, and a securing device for releasably joining the front and back crotch flaps to define leg openings. The front and back crotch flaps can be sewn together or can overlap when joined, and can be secured by at least one set of cooperating stud and socket snap fasteners. A pocket on at least one of the front and back crotch flaps or the torso covering includes an access opening with a closure.

Other exemplary aspects and advantages of the present invention may be ascertained by reviewing the present disclosure and the accompanying drawings.

The invention resides not in any one of these features per se, but rather in the particular combinations herein disclosed, and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

Figure 1:
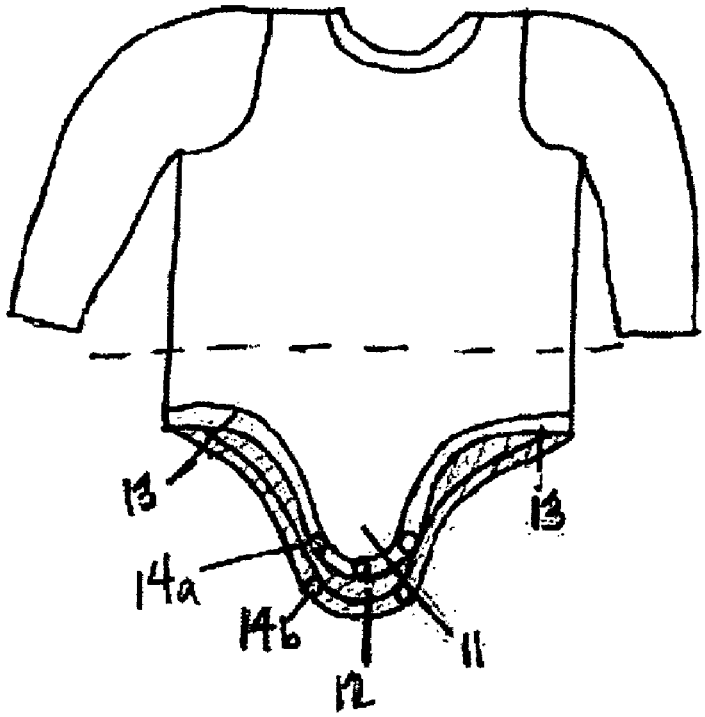
FIG. 1 is an exterior front-view of the one-piece bodysuit.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

REFERENCE NUMBERS

The following is a list of reference numerals used in the drawings:

12 back crotch flap
13 leg seam binding
14 snap fasteners
14*a*—stud snap fasteners
14*b*—socket snap fasteners
15 storage pocket for elastic bands and cord-lock fastener
16 elastic bands
17 cord-lock fastener
18 hook and loop fastener for storage pocket
19 tacking for elastic bands
20 binding opening for elastic bands The invention pertains to the lower portion of a bodysuit; the neckline, sleeves, fabric and/or color of the bodysuit may vary. FIG. 1 shows the front crotch flap (11) which has three stud snap fasteners (14*a*) at the bottom of the flap on the leg seam binding (13). The binding (13) runs along the entire lower edge of the garment. The back crotch flap (12) contains the three socket snap fasteners (14*b*) that line up with their stud counterparts on the front crotch flap (11) when fastened to form the bodysuit.

Figure 2:
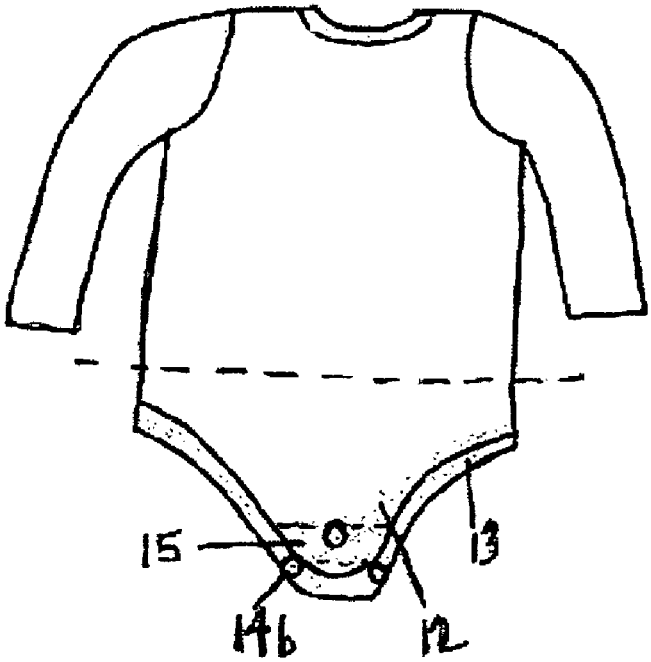
FIG. 2 is an exterior rear-view of the one-piece bodysuit.

FIG. 2 is an exterior perspective of the one-piece bodysuit from the rear. This view from the outside of the back crotch flap (12) shows with dotted lines the location of a storage pocket (15) for cords or bands and a cord fastener on the interior of the back crotch flap (12). The cord can be embodied as an elastic band or bands (16), engaged by a cord-lock fastener (17). Like the front crotch flap (11), the back crotch flap (12) also has the leg seam binding (13) running along the entire lower edge of the garment. This view also depicts the three socket snap fasteners (14*b*) that line up with the stud snap fasteners (14*a*) on the front crotch flap (11). Note that the middle socket snap fastener is positioned at the center of the back crotch flap (12) at the top sewn edge of the storage pocket (15), approximately 1.5 inches from the leg binding (13), rather than lying on the binding (13) as all the other snap fasteners (14) do. This is to accommodate the overlap of the front crotch flap (11) onto the back crotch flap (12) when the crotch of the garment is fastened closed.

Figure 3:
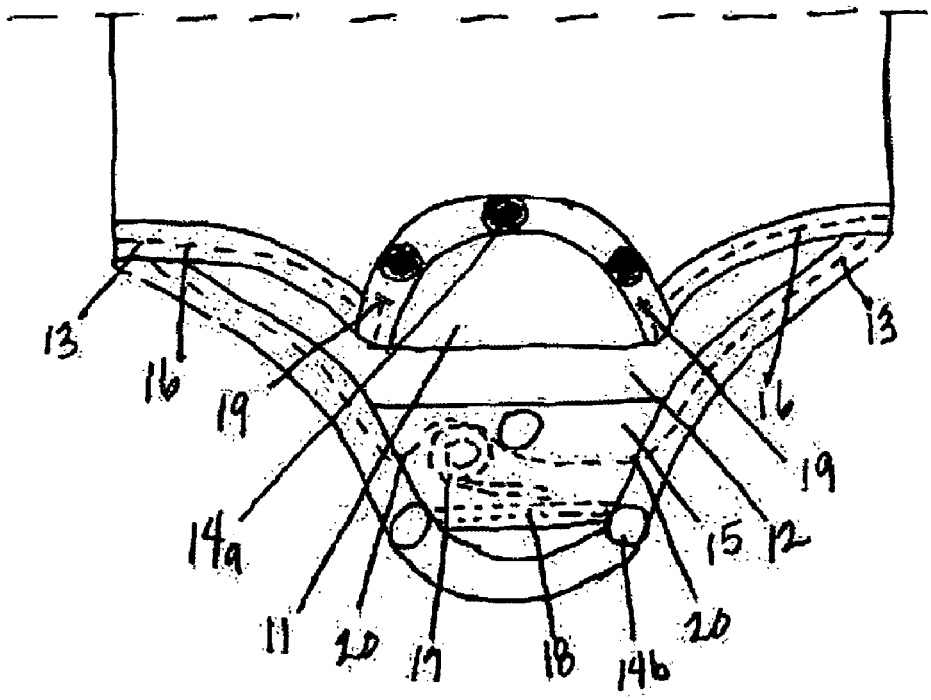
FIG. 3 is a partial interior view with the crotch storage pocket closed.

FIG. 3 presents a close-up interior view of both the front (11) and back (12) crotch flaps of the one-piece bodysuit, showing how the elastic bands (16) and the cord-lock fastener (17) lie within the closed storage pocket (15). The pocket is kept securely closed with a closure device, such as cooperating strips of hook and loop fasteners (18) at the lower edge of the pocket (15). As illustrated, the ends of each elastic band (16) are tacked down (19) within the binding (13) on either side the front crotch flap (11) near the outer snap fasteners (14*a*). Of course, other suitable terminal tack down locations within the binding may be used. Each elastic band (16) is threaded through the leg seam binding (13) to the back crotch flap (12), where each elastic band (16) is then threaded through an opening (20) in the binding to enter the storage pocket. The cord-lock fastener (17) is attached to the ends of both elastic bands (16) within the storage pocket, which can be opened to allow access to the elastic bands (16) and cord-lock fastener (17) in order to adjust the size of the garment as needed. The elastic bands (16) and cord-lock fastener (17) are stored within the storage pocket (15) when not being adjusted. The pocket is sewn closed on the upper part of the back crotch flap (12) and the opening at the lower edge near the leg seam binding (13) is kept securely closed by closure fastener (18) and remains closed during wear. FIG. 3 also shows the location of the three stud snap fasteners (14*a*)—positioned on the front crotch flap (11) along the leg seam binding (13)—and the correlating position of the socket snap fasteners (14*b*) on the back crotch flap (12)—the two outer socket snap fasteners (14*b*) on the leg seam binding (13), with the center socket snap fastener (14*b*) at the top of the storage pocket (15) along the edge of the storage pocket that is sewn closed.

Figure 4:
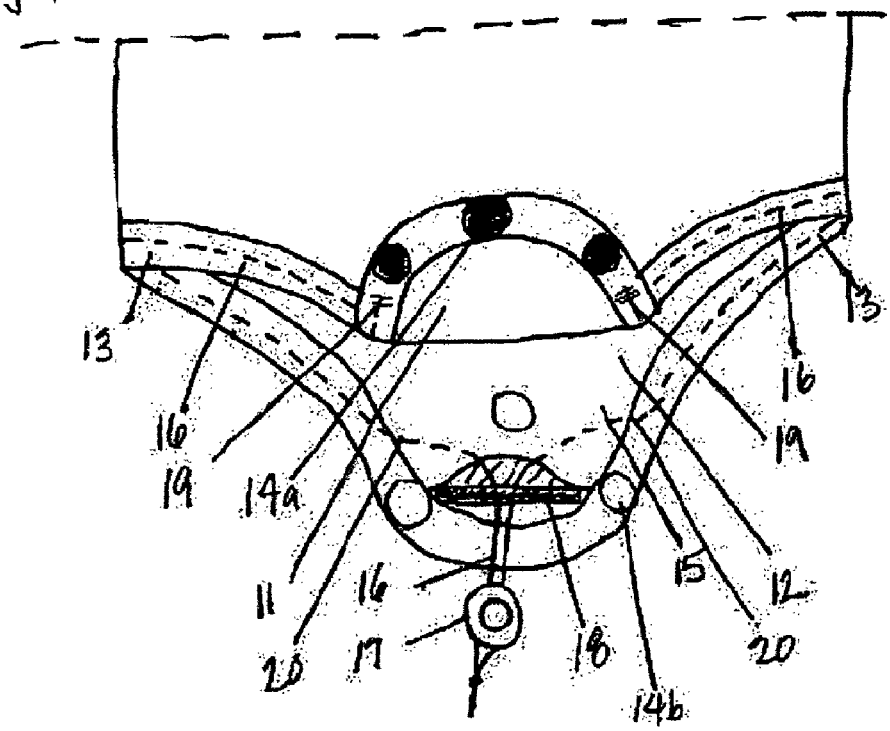
FIG. 4 is a partial interior view with the crotch storage pocket open.

FIG. 4 illustrates a close-up interior view of both the front and back crotch flaps of the one-piece bodysuit with the storage pocket (15) open and the cord-lock fastener (17) and elastic bands (16) extended out of the pocket as they would be when adjusting the size of the garment. As depicted in this figure, when the user desires to adjust the crotch length of the garment, it is only necessary to detach the hook and loop fastener (18) to open the storage pocket (15), revealing the exposed, accessible portions of the elastic bands (16) that are not threaded into the leg seam binding (13) along with the attached cord-lock fastener (17). The user can then depress the cord-lock fastener (17) and either increase or decrease the amount of elastic bands that are pulled through the cord-lock fastener, creating a drawstring effect that results in a tightening or loosening of the crotch and leg openings of the garment as needed.

Operation

In operation one wears the one-piece bodysuit in the traditional manner, with the arms through the sleeves and fastened as a bodysuit by attaching the back crotch flap (12) to the front crotch flap (11) at the crotch with snap fasteners (14). Elastic bands (16) are threaded through the inside of the entire leg seam binding (13), except for the small portions that exit out of the binding openings (20) into the storage pocket (15) where the cord-lock fastener (17) is attached. The user can, when desired, adjust the length of the garment at the crotch by pulling the elastic bands (16) through the cord-lock fastener (17), thereby shortening the length of the garment and tightening the leg openings, which are created when the front crotch flap (11) and back crotch flap (12) are joined with the closure of the socket and stud snap fasteners (14). The contraction of the elastic bands (16) through the cord-lock fastener (17) provides a gathering force upon the garment, which is held securely in place with the cord-lock fastener (17).

More specifically, when the elastic bands (16) are tightened through the cord-lock fastener (17) the leg seam binding becomes gathered with the effect of reducing the size of the openings for the legs and shortening the garment's length to form a snug fit. Once the desired length and tightness of the elastic bands (16) is attained, the exposed elastic bands (16) and cord-lock fastener (17) are tucked inside the storage pocket (15) on the inside of the back crotch flap (12), which pocket is then held securely closed during wear by a strip of hook and loop fastener (18).

When the user wishes to increase the size of the leg openings and the length of the garment, it is only necessary to remove the exposed elastic bands (16) and cord-lock fastener (17) from the storage pocket (15), release the cord-lock fastener (17) and pull the elastic bands (16) back through the cord-lock fastener (17) to loosen the gathered fabric, thereby extending the crotch length of the garment and the diameter of the leg openings.

The components of the expandable one-piece bodysuit can be embodied in various ways without departing from the scope of the invention. The cord or bands (16) used to gather the leg opening can be inextensible, rather than elastic, where a resilient leg opening is not desired. Moreover, a single cord can extend through each leg opening binding with a single or multiple fastener(s) at the common accessible portions. The cord-lock fastener (17) can be embodied by any device that holds and tensions the cord, or simply by a knot, depending on the convenience desired. Although the crotch flap securing device has been disclosed as stud and socket snap fasteners (14), the objects of the invention could be attained using other crotch flap fasteners including buttons, hook and eye fasteners, hook and loop type fasteners, or the crotch may be sewn closed. Similarly, one or more pockets could be placed in any position on the lower portion of the garment and the pocket closure device(s) (18) could be formed by a zipper, snaps, or other suitable connectors.

In another aspect of this invention, a garment can include bands, for example elastic bands, within the leg seam bindings with a fastener, for example a cord lock fastener, to gather the fabric and make the garment more snug fitting. Such a construction would be suitable when, for example, the garment does not have separate front and back flaps, but where the crotch is sewn closed, and the length of the garment and the diameter of the leg openings expand or contract through elastic bands in the leg openings that are operated with the fasteners on the outer seam on the leg openings. For example, the alternative embodiment could include a one-piece bathing suit without snaps at the crotch that has elastic bands running through the leg seams and a cord lock fastener on the outside of the hip area that expands or contracts the leg opening and length.

Note that the top of the garment, for example the one-piece bodysuit, can be either short-sleeved, long-sleeved, or sleeveless, and may have various types of collars (e.g., crew neck, turtle neck, button-panel, etc.) and/or designs upon the bodice. Further, as the invention pertains to the lower portion of the bodysuit, the garment can alternatively be embodied as the lower portion only, for example a swimsuit bottom, bloomers, short pants, or any other suitable article of clothing worn on the lower torso. Furthermore, the one-piece bodysuit has been designed for use in children's clothing, but the invention also can be made to scale for adolescents, preteens, teens and adults.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

It is noted that the foregoing examples have been provided merely for the purpose of explanation and are in no way to be construed as limiting of this disclosure. While this disclosure has been described with reference to exemplary embodiments, it is understood that the words which have been used herein are words of description and illustration, rather than words of limitation. Changes may be made, within the purview of the appended claims, as presently stated and as amended, without departing from the scope and spirit of this disclosure in its aspects. Although this disclosure has been described herein with reference to particular means, materials and embodiments, this disclosure is not intended to be limited to the particulars disclosed herein; rather, this disclosure extends to all functionally equivalent structures, methods and uses, such as are within the scope of the appended claims.

What is claimed is:

1. A garment, comprising:

front, back and crotch portions, the front and back portions having a length extending down to the crotch portion;

leg openings having a diameter formed at lower edges of the front, back and crotch portions;

said lower edge comprising a leg seam binding with an internal passage extending around the circumference of each leg opening; and an adjustment device for changing the length of the garment and the diameter of the leg openings simultaneously, wherein said adjustment device comprises at least one cord, extending within and at least partially through a binding around each of the leg openings, so as to be movable therein, wherein said at least one cord comprises a cord for each leg opening, said cord having a first end secured within the binding of each leg opening; and wherein said leg seam binding comprises an opening through which said cord extends to provide an exposed accessible cord portion, whereby said cord is fixed at one end within the binding and can move freely within said binding along its length to increase or decrease the length of the accessible portion and gather or release the garment between the fixed end and the opening.

2. The garment of claim 1, wherein said accessible portion of each said cord has a fastener, and said fastener is releasably fixed along a length of each said accessible portion to determine a length extending out of said opening.

3. The garment of claim 2, wherein a single common fastener joins the accessible portions of each cord to determine the exposed length and simultaneously holds each accessible portion at a desired adjustment to determine an amount of gathering, the length of the garment and the diameter of the leg openings.

4. The garment of claim 3, wherein said crotch portion is formed from front and back crotch flaps; and further comprising at least one crotch fastener for releasably joining said front and back crotch flaps.

5. The garment of claim 4, further comprising: a storage pocket on at least one of said front or back crotch flaps; and wherein each said leg seam binding opening opens into said pocket and the accessible portions of each cord extend into the pocket, such that the accessible portions and said common fastener can be located within said pocket; said pocket having an access opening to access said accessible portions and said fastener, and a closure device for releasably closing said access opening.

6. The garment of claim 5, wherein said closure device comprises cooperating strips of hook and loop fasteners.

7. The garment of claim 3, wherein said common fastener is a cord-lock fastener.

8. The garment of claim 1, wherein said at least one cord comprises an elastic band.

9. A garment, comprising:

front, back and crotch portions, the front and back portions having a length extending down to the crotch portion;

leg opening having a diameter formed at lower edges of the front, back and crotch portions;

said lower edges comprising a leg seam binding with an internal passage extending around the circumference of each leg opening; and an adjustment device for changing the length of the garment and the diameter of the leg openings simultaneously, wherein said adjustment device comprises at least one cord, extending within and at least partially through a binding around each of the leg openings, so as to be movable therein, and wherein a single cord passes through both leg seam bindings and each said accessible portion is continuous with the other and attached to a fastener.

10. A garment, comprising:

front, back and crotch portions, the front and back portions having a length extending down to the crotch portion;

leg openings having a diameter formed at lower edges of the front, back and crotch portions;

said lower edges comprising a leg seam binding with an internal passage extending around the circumference of each leg opening; and an adjustment device for changing the and the diameter of the leg openings simultaneously, wherein said adjustment device comprises at least one cord, extending within and at least partially through a binding around each of the leg openings, so as to be movable therein, wherein said crotch portions are sewn together to form leg openings;

wherein said leg seam binding comprises an opening through which said cord extends to provide an exposed accessible cord portion; whereby both ends of said cord are accessible through the opening and said cord can move freely within said binding along its length to increase or decrease the length of accessible portions of the cord and gather or release the garment between the accessible portions of the cord for changing leg opening diameter and crotch length, simultaneously; and whereby the garment is expanded or contracted to the size of the wearer.

11. The garment of claim 10, wherein the accessible portions of each cord has a fastener that is releasably fixed along a length of each accessible portion to determine a length extending out of said opening.

12. The garment of claim 11, wherein a single common fastener joins the accessible portions of each cord to determine the exposed length and simultaneously holds each accessible portion at a desired adjustment to determine an amount of gathering, the length of the garment and the diameter of the leg openings.

13. The garment of claim 12, further comprising a pocket formed on the inside of at least one of the front and back crotch flaps or torso covering, the pocket including an access opening; such that items may be stored in and removed from said pocket.

14. The garment of claim 13, wherein said pocket is located near the side seam of the torso covering approximately near the hip of a wearer.

* * * * *